US005632323A

United States Patent [19]

Næss, Jr. et al.

[11] Patent Number: 5,632,323

[45] Date of Patent: May 27, 1997

[54] CASTING EQUIPMENT FOR CASTING METAL

[75] Inventors: Harald Næss, Jr.; Idar K. Steen, both of Sunndalsøra, Norway

[73] Assignee: Norsk Hyro a.s., Oslo, Norway

[21] Appl. No.: 360,785

[22] PCT Filed: May 2, 1994

[86] PCT No.: PCT/NO94/00080

§ 371 Date: Dec. 30, 1994

§ 102(e) Date: Dec. 30, 1994

[87] PCT Pub. No.: WO94/25202

PCT Pub. Date: Nov. 10, 1994

[30] Foreign Application Priority Data

May 3, 1993 [NO] Norway ..... 931597

[51] Int. Cl.[6] ..... B22D 11/124

[52] U.S. Cl. ..... 164/444; 164/487

[58] Field of Search ..... 164/444, 487

[56] References Cited

U.S. PATENT DOCUMENTS

| | | | |
|---|---|---|---|
| 2,791,812 | 5/1957 | Dangelzer et al. . | |
| 4,166,495 | 9/1979 | Yu . | |
| 4,285,388 | 8/1981 | Sevastakis | 164/444 |
| 4,572,280 | 2/1986 | Haller . | |
| 4,693,298 | 9/1987 | Wagstaff . | |
| 5,074,353 | 12/1991 | Ohno . | |
| 5,452,756 | 9/1995 | Ohatake et al. | 164/444 |

FOREIGN PATENT DOCUMENTS

| | | | |
|---|---|---|---|
| 56-136257 | 10/1981 | Japan | 164/444 |

OTHER PUBLICATIONS

A.T. Taylor et al., "Direct Chill Casting of Large Aluminum Ingots", pp. 70–74, *Metal Progress,* Nov. 1957.

*Primary Examiner*—Kuang Y. Lin

*Attorney, Agent, or Firm*—Wenderoth, Lind & Ponack

[57] ABSTRACT

Metal casting apparatus for continuous or semi-continuous casting of metal (DC casting), in particular casting of roll blocks of aluminum. The casting equipment includes a casting die which has an open inlet for receiving a supply of molten metal and a cavity with an open outlet. A continuous outlet along the circumference of the passage through the casting die is provided for supplying water for direct cooling of the molten metal in connection with the formation of a cast billet. An outlet is provided for supplying a gas, such as air, in order to reduce the cooling effect, at least during the start phase of the casting process. The air outlet is provided between the water outlet and the die passage and predominantly in parallel with the latter. The air outlet passing along the circumference of the passage through the casting die, for supplying air in such a way that a skirt of air is formed which is designed to deflect the skirt of water and/or form an air cushion between the skirt of water and the cast billet.

3 Claims, 1 Drawing Sheet

CASTING EQUIPMENT FOR CASTING METAL

BACKGROUND OF THE INVENTION

The present invention relates to casting apparatus for continuous or semi-continuous direct chill casting of metal (DC casting). In particular, the apparatus is used for casting billets of aluminum for milling purposes. The casting apparatus includes a casting die which has an open inlet for receiving a supply of molten metal and a cavity with an open outlet. At the outlet, means are provided for supplying water for direct cooling of the molten metal and for supplying gas or air for reducing the cooling effect of the water, at least during the start phase of the casting process.

By using various methods, it has been shown that reduced cooling during the start phase of DC casting of metal results in positive effects with regard to shrinkage, start cracks and surface quality. It is also likely that the reduced cooling has a positive effect with respect to other problems associated with casting large billets.

In a known method which is disclosed in U.S. Pat. No. 4,693,298, air is added to the water before it leaves the water outlet. The water and air mixture then passes along the circumference of the casting die opening. The direction of the inlet of air in relation to the water is approximately 90° so that air bubbles are produced in the water flow, i.e. the air is mechanically mixed with the water in the water flow. By replacing some of the volume of water with air, the intention is to achieve a uniform skirt of water with less water than is normally required to maintain a uniform skirt of water and, by means of the air, to achieve an insulating effect. The addition of air will, however, increase the speed of the water and thus also the cooling effect of a given quantity of water as the cooling water passes through the stream phase on the surface of the cast billet. Any reduction of the cooling effect of the water, caused by adding air to the cooling water before it leaves the water outlet, is therefore limited. Moreover, the solution as shown in the above patent offers no opportunities for differentiated cooling, i.e. a different level of cooling for one area in relation to another area along the casting die.

In a similar known solution, which is described in U.S. Pat. No. 4,166,495, $CO_2$ is added to the cooling water instead of air. When the water exits the water outlet in the casting die, very small bubbles of $CO_2$ will be formed due to the pressure drop and the increase in temperature. The $CO_2$ bubbles form a partial insulating layer between the cast billet and the cooling water so that the overall cooling area is reduced. This method produces roughly the same reduction of cooling effect as the first-described method, but is more expensive to use because $CO_2$ is used as the additive gas. Also, $CO_2$ requires additional pressure regulating equipment and mixing equipment in order to obtain the necessary pressure conditions for the process to work. As above in the first-described method, this method does not provide any opportunity for differentiated cooling along the casting die or regulation of the cooling effect.

Furthermore, an article published in *Metal Progress* (No. 2 of 1957, pages 70–74), described a method for reduced or aborted cooling in which air nozzles are positioned slightly below the casting die. When the cooling water flows down over the cast billet and when the water reaches the nozzles, the water is blown away from the billet so that the area of the billet below the air nozzles is not exposed to direct water cooling. Only the area of the billet above the nozzles is directly cooled by the water. This solution does not reduce the cooling during the start phase of the casting process, and therefore, the positive effects realized regarding shrinkage and surface quality are small or insignificant.

OBJECTS OF THE PRESENT INVENTION

An object of the present invention is to provide DC casting equipment of the type which is at least as simple as, or more simple, than the known solutions but which provides considerably greater flexibility with regard to regulation of the cooling effect. A further object is to provide an increased opportunity for reducing the cooling effect during the start phase of the casting process. Furthermore, by the present invention, the DC casting apparatus makes it possible to differentiate or vary the cooling effect around the passage through the casting die by means of sectional control of the rate of cooling so that optimal cooling conditions can be obtained, for example, in the corners and on the short sides where most of the problems arise during the start phase of the casting process.

SUMMARY OF THE INVENTION

The present invention is characterized in that, between the water outlet and predominantly in parallel with it along the circumference of the opening formed by the casting die, a further outlet, row of holes or similar arrangement is provided for supplying gas, such as air, so that a skirt of gas is formed along the outer periphery of a billet. The gas is provided to deflect a skirt of a cooling fluid, such as water, and/or form an air cushion between the skirt of water and the billet.

BRIEF DESCRIPTION OF THE DRAWINGS

The present invention will be described in the following in further detail by means of examples and with reference to the drawings, of which.

DETAILED DESCRIPTION OF THE INVENTION

Figure 1:
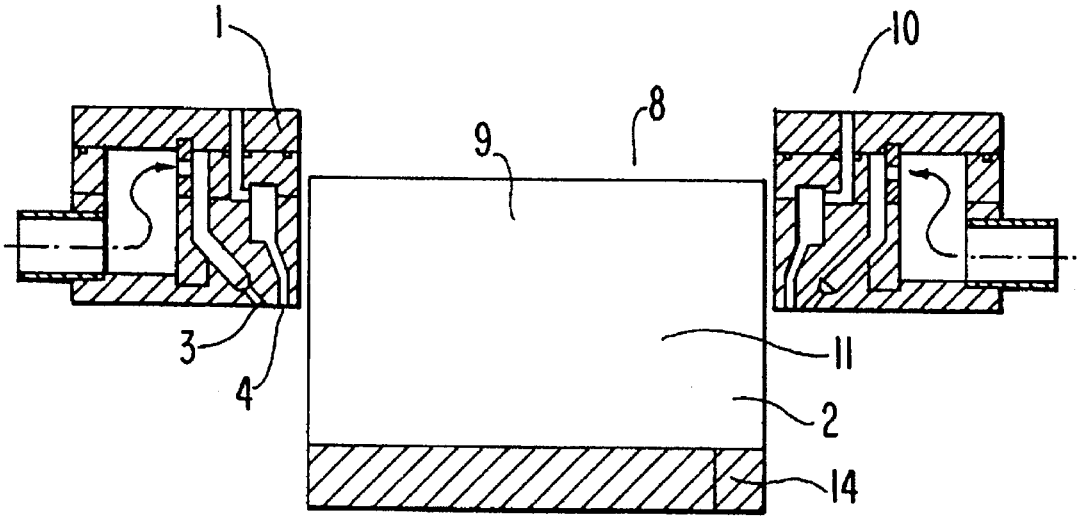
FIG. 1 shows a cross section of a casting die in accordance with the present invention.

As stated above, FIG. 1 shows casting equipment 10 in accordance with the present invention. The casting equipment 10 includes a die 1 defining an open upper portion forming an inlet 8 for receiving molten metal, a cavity or passage 9, and a lower surface forming an outlet 11 for a finished solidified metal product, such as a cast metal billet, ingot or the like 2. The casting die 1 is preferably made of metal. The casting equipment also includes a support 14, which can be moved vertically. The support 14 seals the outlet 11 at the start of the casting process and supports the cast metal billet 2 as it is formed by means of controlled downward movement of the support 14. The cast metal billet 2 is cast with the die 1 and support 14 in defined lengths and the operation is therefore defined as being semicontinuous.

The casting die 1 is provided with a water supply inlet, a water chamber, and water supply ducts which emerge in an outlet 3. The outlet 3 may take the form of an annular row of holes or other similar arrangement. Also, the outlet 3 passes along the full circumference of the cavity 9 along the lower side of the casting die 1. The outlet 3 can be divided up into sections (not shown in detail) to enable the quantity of water to be regulated. In other words, the cooling effect around the circumference of the cavity can be differentiated, which is particularly desirable in connection with casting billets in order to obtain optimum cooling conditions during the start phase of the casting process. Since the water outlet 3 extends all the way around the cavity 9, a continuous skirt of water 16 is formed so as to surround the billet 2 during the casting process.

The casting itself takes place by supplying molten metal to the die 1 via inlet 8, and as the support 14 is lowered, the metal will gradually harden as it passes through the cavity 9. The metal is initially cooled in an external "shell" in the cavity during the primary cooling process. Then the metal is further cooled during a secondary cooling process inside the metal billet when it passes out of the die outlet 11.

A special feature of the present invention is that a supply duct terminating in a further outlet 4 in the form of a row of holes or similar arrangement, is provided between the water outlet 3 and the die outlet 11. The outlet 4 is provided on the underside of the casting die 1, for supplying a gas such as air or the like. The purpose of this air outlet, which preferably also passes along the full circumference of the cavity 9, is to produce a skirt of air 15 which deflects the skirt of water 16 emitted from water outlet 3 and/or form an air cushion between the metal billet and the skirt of water 16.

Figure 2:
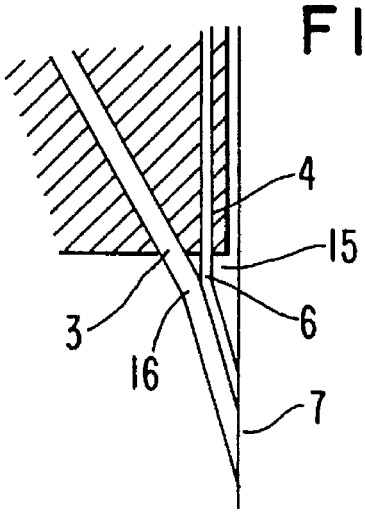
FIG. 2 shows an enlarged view of a portion of the casting die shown in FIG. 1 in order to illustrate the operation of a first embodiment of the present invention.

FIG. 2 shows an enlarged view of a portion of the casting die 1 shown in FIG. 1, more precisely the lower, left portion of the casting die 1 which illustrates the operation of the invention. The water projecting from outlet 3 forms an angle in relation to the longitudinal axis of the cast billet 2 in such a way that the skirt of water 16 extends downwardly at an angle towards the cast billet 2. The air outlet 4 is arranged so that a skirt of air 15 is parallel with the peripheral surface of the cast billet 2. Air supplied through air outlet 4 will deflect the skirt of water (at 6) so that the water contacts the cast billet 2 at a lower point 7. The amount of deflection can be increased or reduced by increasing or reducing the quantity of air and/or the quantity of water. It should be noted here that the quantity of air, in a similar fashion to the water, can be controlled in sections about the circumference of the cast billet 2 in order to optimize cooling during the casting process.

Studies of the flow of water show that the air, which deflects the skirt of water, also penetrates and forms bubbles in the water. Consequently, in addition to the reduced cooling which is achieved by lowering the point at which the water meets the cast billet, further reduced cooling is achieved due to the insulating effect of the bubbles and because portions of the water in the flow of water are blown away from the cast billet 2.

Figure 3:
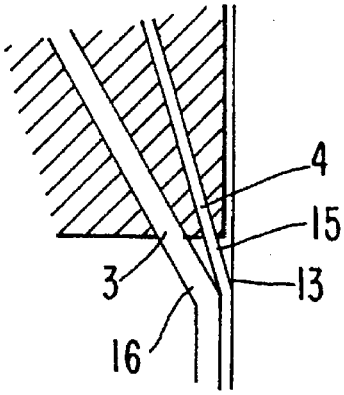
FIG. 3 shows an enlarged view of a portion of the casting die as in FIG. 2, but in accordance with a second embodiment in which the air outlet and water outlet have different outlet angles.

FIG. 3 shows an alternative arrangement in accordance with the present invention, in which the air outlet 4 forms an angle 13 with the outer peripheral surface of the cast billet. This particular orientation of the air outlet 4 causes the skirt of air 15 to meet the cast billet just above the point at which the skirt of water 16 would meet the cast billet 2 so that an air cushion is formed between the cast billet 2 and the skirt of water 16.

It should be noted that the present invention, as defined in the appended claims, is not limited to the specific angles of the water outlet and the air outlet shown in the figures. Nor are there any restrictions with regard to the amount of air or water which can be supplied or the ratio between the quantities of these two media. Thus, the present invention, as defined in the appended claims, can be varied with regard to the quantity of air, the quantity of water, and the specific angles so that optimal, differentiated cooling with full or partial deflection of the skirt of water can be achieved. This also means that both the air and the water can be supplied intermittently, i.e. in pulses.

We claim:

1. Casting apparatus for continuous or semi-continuous casting of metal, the apparatus comprising:

a die having an open top end, an open bottom end, and an internal peripheral surface defining a passage for receiving molten metal and passing a solidified metal product, said passage extending between said open top end and said open bottom end;

said die further having:

a first outlet structure, in a bottom portion of said die, for supplying a cooling fluid skirt to a solidified metal product, a second outlet structure, in a bottom portion of said die, for supplying a deflecting skirt of gas; and a source of gas connected to said second outlet structure for supplying said deflecting skirt of gas, wherein said second outlet structure surrounds said die passage and is located between said internal peripheral surface of said die and said first outlet structure so that a fluid skirt emitted from said first outlet structure will be deflected, prior to contacting a solidified metal product, by a gas skirt emitted from said second outlet structure in order to reduce the cooling effect of the fluid.

2. Casting apparatus as claimed in claim 1, wherein said second outlet structure is oriented so that a gas skirt emitted therefrom will project in a direction parallel to said internal peripheral surface of said die to form a gas cushion between the skirt of fluid and a peripheral surface of a solidified metal product.

3. Casting apparatus as claimed in claim 1, wherein said second outlet structure is oriented so that a gas skirt emitted therefrom will project at an angle relative to said internal peripheral surface of said die.

* * * * *